US009031481B2

(12) United States Patent
Hironaka

(10) Patent No.: US 9,031,481 B2
(45) Date of Patent: May 12, 2015

(54) DRUM CARTRIDGE

(71) Applicant: Keita Hironaka, Obu (JP)

(72) Inventor: Keita Hironaka, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/024,995

(22) Filed: Sep. 12, 2013

(65) Prior Publication Data

US 2014/0072336 A1 Mar. 13, 2014

(30) Foreign Application Priority Data

Sep. 12, 2012 (JP) ..... 2012-200391

(51) Int. Cl.
*G03G 21/18* (2006.01)
*G03G 21/16* (2006.01)

(52) U.S. Cl.
CPC ..... *G03G 21/1619* (2013.01); *G03G 21/1695* (2013.01); *G03G 21/1814* (2013.01)

(58) Field of Classification Search
USPC ..... 399/111, 316
See application file for complete search history.

(56) References Cited

U.S. PATENT DOCUMENTS

| | | | | |
|---|---|---|---|---|
| 4,534,852 | A | 8/1985 | Washecheck et al. | |
| 4,882,606 | A * | 11/1989 | Deguchi | 399/316 |
| 7,113,734 | B2 | 9/2006 | Deguchi et al. | |
| 7,346,304 | B2 | 3/2008 | Takagi | |
| 8,055,171 | B2 | 11/2011 | Ueyama et al. | |
| 2005/0069363 | A1 | 3/2005 | Aoki et al. | |
| 2006/0171760 | A1 | 8/2006 | Deguchi | |
| 2006/0238788 | A1 | 10/2006 | Takagi | |
| 2007/0269242 | A1 | 11/2007 | Hattori et al. | |
| 2007/0269243 | A1 | 11/2007 | Uehara et al. | |
| 2007/0269244 | A1 | 11/2007 | Miwa et al. | |
| 2008/0298859 | A1 | 12/2008 | Ueyama et al. | |

FOREIGN PATENT DOCUMENTS

| | | |
|---|---|---|
| JP | 2005-128482 A | 5/2005 |
| JP | 2006-301490 A | 11/2006 |
| JP | 2008-026808 | 2/2008 |
| JP | 2008-026809 | 2/2008 |
| JP | 2008-297044 A | 12/2008 |

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A drum cartridge including: a photosensitive drum; and a guide member configured to guide a recording medium towards the photosensitive drum and including, a first guide member having flexibility, extending towards the photosensitive drum, and having a guide surface configured to guide the recording medium, and a second guide member having flexibility, contacting a surface of the first guide member opposite to the guide surface, and supporting the first guide member, the second guide member including, a first part extending towards the photosensitive drum, and a second part bent continuously from a downstream end of the first part in a guide direction and extending towards a transfer position side, wherein, in the guide direction, a downstream end of the first guide member is arranged downstream of the downstream end of the first part.

6 Claims, 6 Drawing Sheets

DRUM CARTRIDGE

CROSS-REFERENCE TO RELATED APPLICATIONS

This application claims priority from Japanese Patent Application No. 2012-200391 filed on Sep. 12, 2012, the entire contents of which are incorporated herein by reference.

TECHNICAL FIELD

Aspects of the invention relate to a drum cartridge that is provided to an image forming apparatus of an electrophotographic type.

BACKGROUND

As an image forming apparatus of an electrophotographic type, a printer has been known which has a photosensitive drum, on which a toner image is carried, and a transfer roller facing the photosensitive drum. The printer brings a leading end of a sheet into contact with the photosensitive drum, introduces the same between the photosensitive drum and the transfer roller by rotation of the photosensitive drum and transfers a toner image onto the sheet.

Specifically, related-art discloses a process cartridge which has a film member for guiding a sheet upstream of a photosensitive drum in a rotating direction thereof.

Another related-art discloses a process cartridge which uses a bent film, which can guide a sheet and is formed to be bent towards a transfer position, upstream of a photosensitive drum in a rotating direction thereof.

In the process cartridge disclosed in related-art, a conveyance speed of the sheet is increased so as to make a printing speed faster and a transfer current is increased so as to securely transfer a toner image onto the sheet in a short time. In this case, a discharge trace (rear end disarray) is apt to form on the sheet when a rear end of the sheet falls off the film member, which is a problem.

Regarding this, when the bent film is used as disclosed in related-art, the sheet can be guided till just in front of the transfer position. Therefore, it becomes difficult for the rear end of the sheet to fall off the film, so that it is possible to suppress the discharge trace from being formed.

However, in the process cartridge using the bent film, since the film is bent, the sheet repeatedly rubs against the bent part. As a result, the bent part is worn, which is a problem.

SUMMARY

Accordingly, an object of the invention is to provide a drum cartridge capable of reliably guiding a recording medium to a transfer position and having abrasion resistance against rubbing with the recording medium.

According to an aspect of the present invention, there is provided a drum cartridge including: a photosensitive drum; and a guide member. The photosensitive drum is configured to carry a developer image thereon. The guide member is configured to guide a recording medium, to which the developer image is configured to be transferred, towards the photosensitive drum in a guide direction. The guide member includes a first guide member and a second guide member. The first guide member has flexibility, extends towards the photosensitive drum, and has a guide surface configured to guide the recording medium. The second guide member has flexibility, contacts an opposite surface of the first guide member opposite to the guide surface of the first guide member, and supports the first guide member. The second guide member includes a first part and a second part. The first part extends towards the photosensitive drum and contacts the opposite surface of the first guide member. The second part bends continuously from a downstream end of the first part in the guide direction and extends towards a transfer position side. The developer image carried by the photosensitive drum is transferred at the transfer position. In the guide direction, a downstream end of the first guide member is arranged downstream of the downstream end of the first part.

According to another aspect of the present invention, there is provided a drum cartridge including: a photosensitive drum; a straight film; and a bent film. The straight film is configured to guide a recording medium towards the photosensitive drum. The bent film is arranged at a lower side of the straight film and is configured to support the straight film.

According to the drum cartridge of the invention, it is possible to reliably guide a recording medium to a transfer position and to secure abrasion resistance against rubbing with the recording medium.

BRIEF DESCRIPTION OF DRAWINGS

FIG. 4 illustrates conveyance of a sheet shown in FIG. 3, in which

DETAILED DESCRIPTION

1. Overall Configuration of Printer

Figure 1:
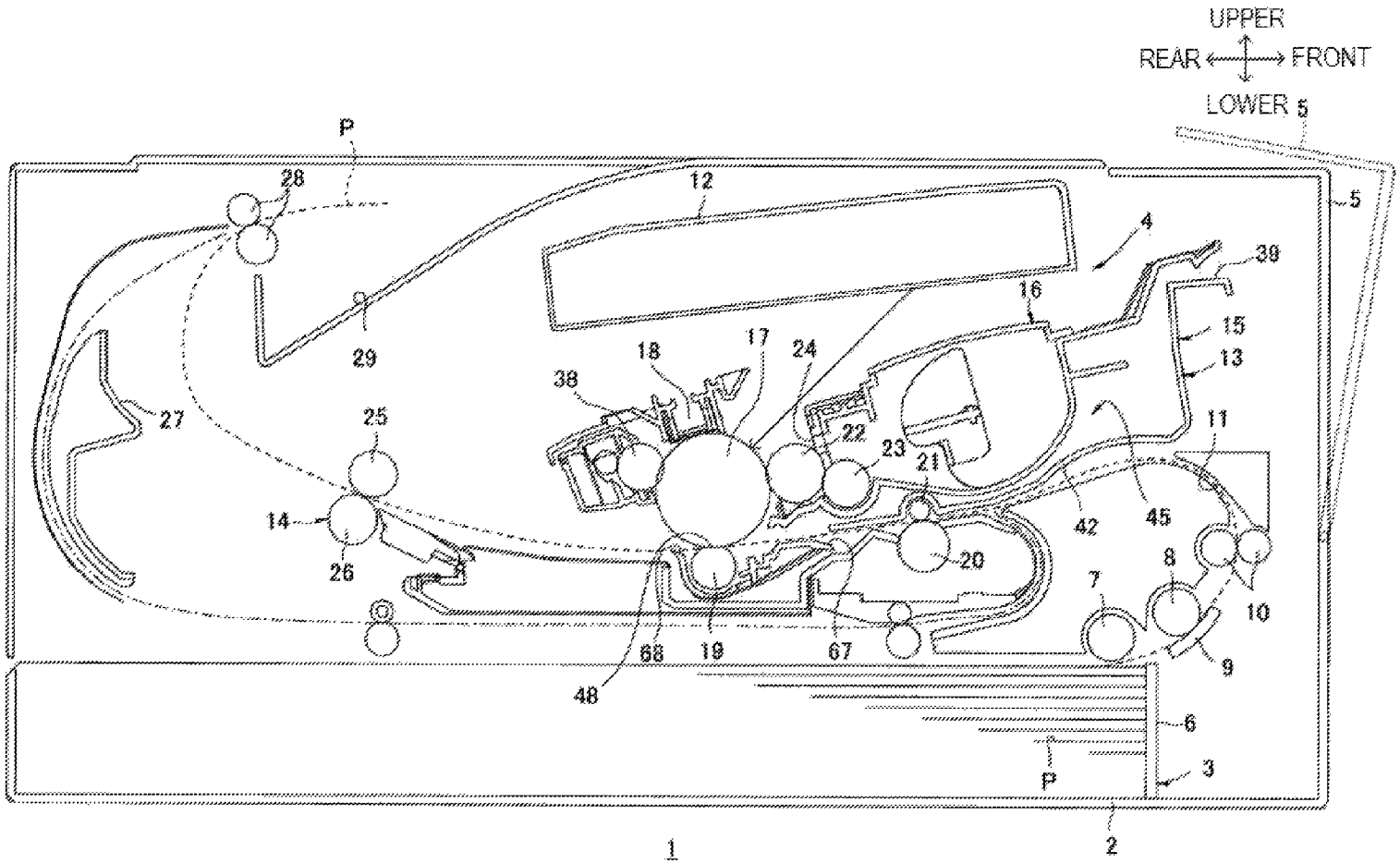
FIG. 1 is a sectional view showing an illustrative embodiment of a printer.

As shown in FIG. 1, a printer 1 has a substantially box-shaped body casing 2.

Also, the printer 1 has, in the body casing 2, a feeder unit 3 for feeding a sheet P, which is an example of the recording medium, and an image forming unit 4 for forming an image on the fed sheet P.

(1) Body Casing

The body casing 2 has a front cover 5 for detaching and attaching a process cartridge 13 (which will be described later). The front cover 5 is provided to the body casing 2 so that it can be rotated about a lower end portion thereof serving as a support point.

Meanwhile, in the following description, when referring to a direction of the printer 1, upper and lower sides are defined based on a state where the printer 1 is horizontally placed. That is, a sheet upper side of FIG. 1 is referred to as the upper side (one side of the first direction (upper-lower direction)) and a sheet lower side is referred to as the lower side (the other side of the first direction (upper-lower direction)). Also, a side (right side in FIG. 1) to which the front cover 5 is provided is referred to as the front side (one side of the second direction (front-rear direction)) and an opposite side (left side in FIG. 1) is referred to as the rear side (the other side of the second direction (front-rear direction)). In addition, the left and the right are defined when seen from the front side of the printer 1. In other words, the sheet front side in FIG. 1 is the left side (one side of the third direction (left-right direction)) and the sheet back side is the right side (the other side of the third direction (left-right direction)).

(2) Feeder Unit

The feeder unit 3 is provided at a lower part of the body casing 2. The feeder unit 3 has a sheet feeding tray 6 that accommodates therein sheets P, a pickup roller 7 that is provided above a front end portion of the sheet feeding tray 6 and a separation roller 8 and a separation pad 9 that are opposed to each other at the front side of the pickup roller 7.

In addition, the feeder unit 3 has a pair of front and rear feeder rollers 10 that is opposed to each other above the separation pad 9, a sheet feeding path 11 that extends from the opposite part of the feeder rollers 10 in a substantially rear-upper direction and a main body-side registration roller 20 that is arranged at the rear of the sheet feeding path 11.

The sheets P are stacked in the sheet feeding tray 6. The uppermost sheet P is fed to the opposing part between the separation roller 8 and the separation pad 9 by rotation of the pickup roller 7. The sheets are separated one by one by the separation roller and the separation pad.

Then, the sheet P passes through the sheet feeding path 11 by conveyance of the feeder rollers 10 and is conveyed towards between the main body side registration roller 20 and a process side registration roller 21 (which will be described later).

Then, the sheet P is conveyed into the process cartridge 13 through a sheet feeding opening 67 (which will be described below) and is then conveyed towards between a photosensitive drum 17 (which will be described later) and a transfer roller 19 (which will be described later) at predetermined timing so that it passes through between a rear-lower end portion of a developing cartridge 16 and a sheet conveyance guide 44 (which will be described later) of a drum cartridge 15.

In the meantime, separately from the feeder unit 3, there is provided a sheet reversing mechanism that returns the sheet P from a sheet discharge path 27 (which will be described later) towards between the main body-side registration roller 20 and the process-side registration roller 21 (refer to the dashed-dotted line in FIG. 1), so that duplex printing can be performed.

(3) Image Forming Unit

The image forming unit 4 has a scanner unit 12, a process cartridge 13 and a fixing unit 14.

(3-1) Scanner Unit

The scanner unit 12 is arranged at an upper part of the body casing 2. The scanner unit 12 emits laser beam towards the photosensitive drum 17 (which will be described later), based on image data, and thus exposes the photosensitive drum 17 (which will be described later), as indicated by a solid line.

(3-2) Process Cartridge (3-2-1) Configuration of Process Cartridge

The process cartridge 13 is detachably accommodated below the scanner unit 12 and above the feeder unit 3 in the body casing 2 and has a drum cartridge 15 and a developing cartridge 16 that is detachably mounted to the drum cartridge 15.

The drum cartridge 15 has the photosensitive drum 17, a scorotron-type charger 18, a drum cleaning roller 38 and the transfer roller 19.

The photosensitive drum 17 is provided at a rear end portion of the drum cartridge 15 in the left-right direction.

The scorotron-type charger 18 is arranged to face the photosensitive drum 17 with an interval therebetween at an upper side of the photosensitive drum 17.

The drum cleaning roller 38 is arranged to face a rear-upper side of the photosensitive drum 17 and contacts the rear-upper side of the photosensitive drum 17.

The transfer roller 19 is arranged to face a lower side of the photosensitive drum 17 and is press-contacted to the lower side of the photosensitive drum 17.

The drum cartridge 15 has the process-side registration roller 21.

The process-side registration roller 21 is provided to contact the main body-side registration roller 20 from the upper side at a substantially central lower end portion of the drum cartridge 15 in the front-rear direction.

The developing cartridge 16 has a developing roller 22.

The developing roller 22 is rotatably supported at a rear end portion of the developing cartridge 16 so that it is exposed from the rear side thereof and, is press-contacted to the photosensitive drum 17 from the front side.

In the meantime, the developing cartridge 16 has a supply roller 23 that supplies toner to the developing roller 22 and a layer thickness regulating blade 24 that regulates a thickness of the toner supplied to the developing roller 22, and toner is accommodated in a front space of the supply roller and the blade.

(3-2-2) Developing Operation in Process Cartridge

The toner in the developing cartridge 16 is supplied to the supply roller 23 and is then supplied to the developing roller 22. The toner is positively friction-charged between the supply roller 23 and the developing roller 22.

A thickness of the toner supplied to the developing roller 22 is regulated by the layer thickness regulating blade 24 as the developing roller 22 is rotated, and the toner is carried, as a thin layer having a predetermined thickness, on a surface of the developing roller 22.

In the meantime, a surface of the photosensitive drum 17 is uniformly and positively charged by the scorotron-type charger 18 as the photosensitive drum 17 is rotated, and is then exposed by high-speed scanning of the laser beam emitted from the scanner unit 12 (refer to the solid line in FIG. 1). Thereby, an electrostatic latent image corresponding to an image to be formed on the sheet P is formed on the surface of the photosensitive drum 17.

When the photosensitive drum 17 is further rotated, the toner, which is carried on the surface of the developing roller 22 and positively charged, is supplied to the electrostatic latent image formed on the surface of the photosensitive drum 17. Thereby, the electrostatic latent image of the photosensitive drum 17 becomes visible and a toner image (which is an example of the developer image) resulting from reversal developing is carried on the surface of the photosensitive drum 17.

When the sheet P conveyed between the photosensitive drum 17 and the transfer roller 19 passes through a nip portion 48 (which is an example of the transfer position) between the photosensitive drum 17 and the transfer roller 19, the toner image carried on the photosensitive drum 17 is transferred onto the sheet P.

(3-3) Fixing Unit

The fixing unit 14 is arranged at the rear side of the process cartridge 13 and has a heating roller 25 and a pressing roller 26 that is opposed to the heating roller 25. In the process cartridge 13, the toner image transferred onto the sheet P is heat-fixed on the sheet P by heating and pressing while the sheet P passes through between the heating roller 25 and the pressing roller 26.

(4) Sheet Discharge

The sheet P having the toner image fixed thereon passes through a sheet discharge path 27 consisting of a U-turn path, is conveyed towards sheet discharge rollers 28 and is then discharged onto a sheet discharge tray 29, which is provided above the scanner unit 12, by the sheet discharge rollers 28.

2. Details of Drum Cartridge

Figure 2:
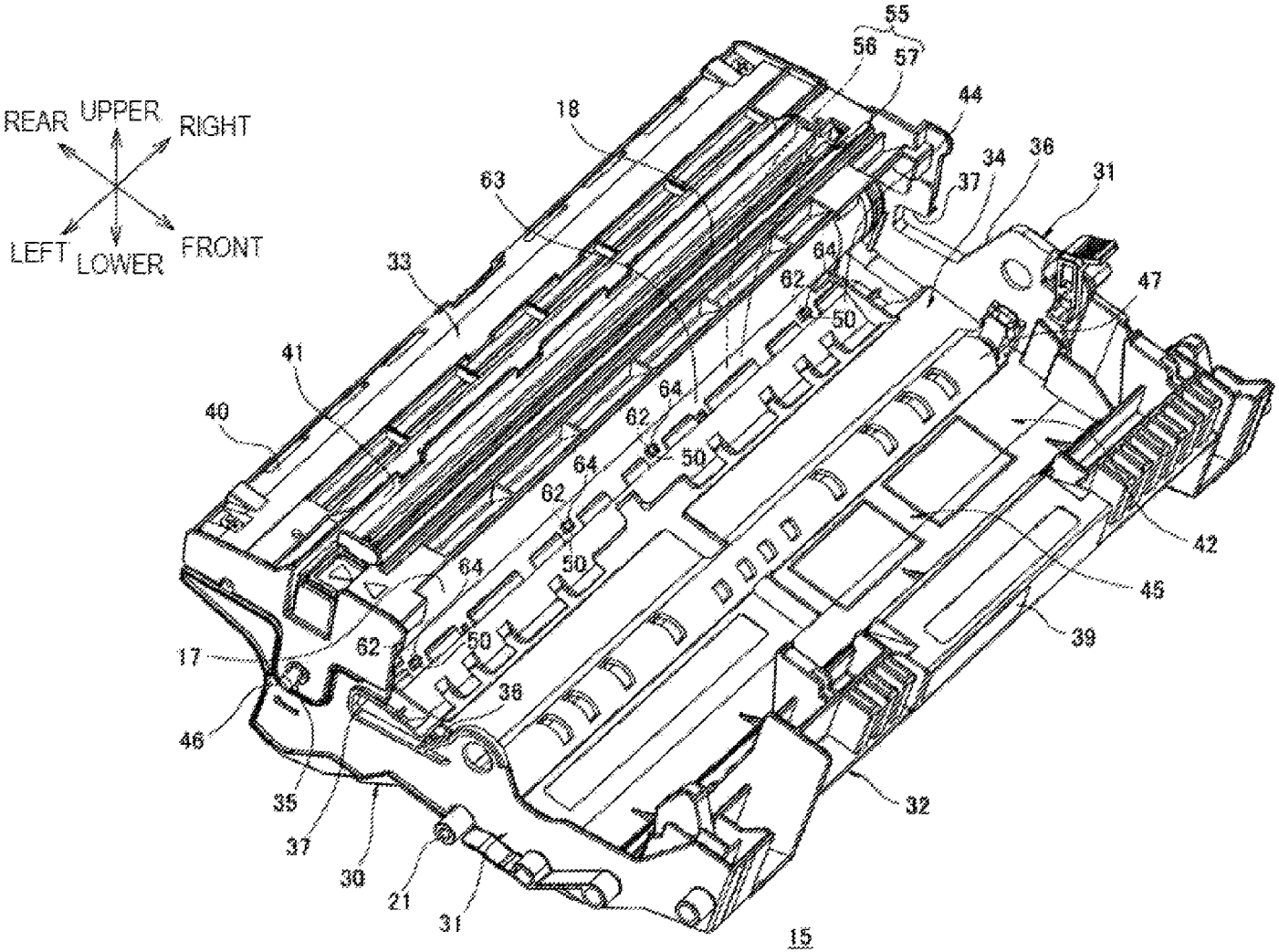
FIG. 2 is a perspective view of a drum cartridge of FIG. 1, which is seen from a left-upper side.
Figure 3:
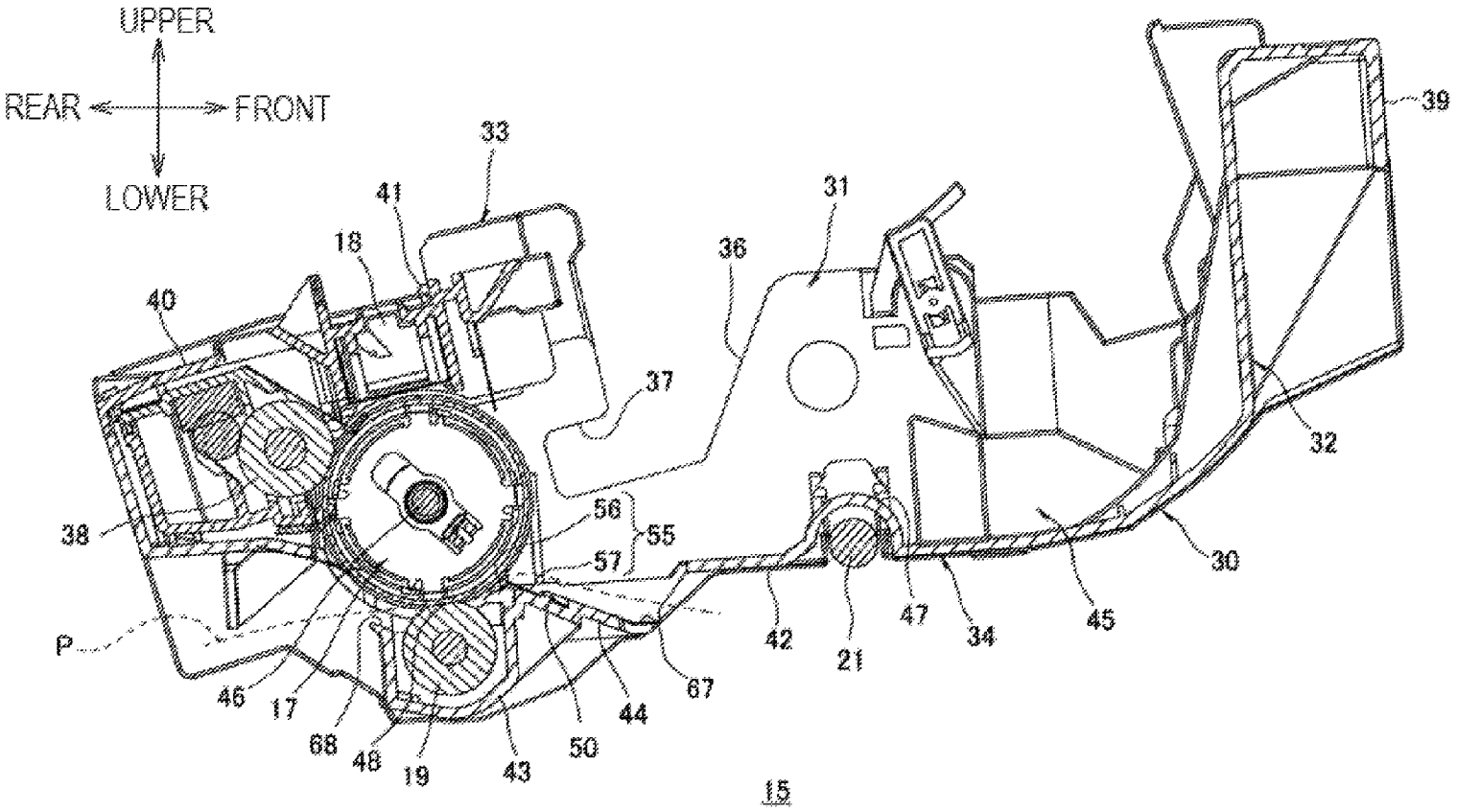
FIG. 3 is a sectional view of the drum cartridge of FIG. 1, which is seen from a left side.

As shown in FIGS. 2 and 3, the drum cartridge 15 has a substantially rectangular frame shape and has a drum frame 30 that is an example of the frame.

The drum frame 30 has a pair of left and right sidewalls 31, a front-side wall 32, an upper-side wall 33 and a lower-side wall 34.

Both the sidewalls 31 have a substantially rectangular shape extending in the upper-lower and front-rear directions, when seen from the side. Both the sidewalls 31 have a drum shaft insertion hole 35 (refer to FIG. 2), a developing roller guide part 36 and a developing roller supporting recess 37, respectively.

As shown in FIG. 2, the drum shaft insertion hole 35 penetrates a rear end portion of the sidewall 31 in the left-right direction, is capable of accommodating a drum shaft 46 of the photosensitive drum 17 and has a substantially circular shape, when seen from the side.

As shown in FIGS. 2 and 3, when seen from the side, the developing roller guide part 36 has a substantially V shape so that it is notched downwards from an upper end edge of the sidewall 31 at a substantially central portion of the sidewall 31 in the front-rear direction and has an open upper side.

When seen from the side, the developing roller supporting recess 37 has a substantially rectangular shape so that it is continuously notched from a lower-rear end portion of the developing roller guide part 36 and extends rearwards. In the meantime, a rear end portion of the developing roller supporting recess 37 is arranged at the front of the drum shaft insertion hole 35 at an interval.

The front-side wall 32 extends in the upper-lower and left-right directions, is provided between front end portions of both the sidewalls 31 and has a substantially rectangular shape, when seen from the front. Also, the front-side wall 32 is provided with a knob 39 at a substantially central portion thereof in the left-right direction, which is held when mounting or demounting the process cartridge 13 to or from the body casing 2.

The upper-side wall 33 extends in the front-rear and left-right directions, is provided between rear-upper end portions of both the sidewalls 31, has a substantially rectangular shape, when seen in the plan view, and is formed to cover the photosensitive drum 17 from the upper and the front. Also, the upper-side wall 33 has a drum cleaning roller holding part 40 and a charger supporting part 41.

The drum cleaning roller holding part 40 has a substantially box shape and is opened at front and lower sides.

The charger supporting part 41 has a substantially thick plate shape that extends forwards continuously from an front-upper end portion of the drum cleaning roller holding part 40 and also has a substantial U-shaped side section that opens downwards at a substantially central portion thereof in the front-rear direction.

The lower-side wall 34 extends in the front-rear and left-right directions, is provided between lower end portions of both the sidewalls 31 and has a substantially rectangular shape, when seen from the plan view. Also, the lower-side wall 34 has a transfer roller accommodation part 43 for accommodating therein the transfer roller 19, a sheet conveyance guide 44 and a developing cartridge supporting part 42 for mounting the developing cartridge 16.

As shown in FIG. 3, the transfer roller accommodation part 43 is provided at a rear end portion of the drum frame 30. The transfer roller accommodation part 43 has a rear end portion which is positioned at an interval at a front-lower side of a front-lower end portion of the drum cleaning roller holding part 40. The transfer roller accommodation part 43 has a substantially U-shaped side section and protrudes downwards so as to follow a circumferential surface of the transfer roller 19.

The sheet conveyance guide 44 has a substantially flat plate shape in which a rear end portion thereof continues from a front end portion of the transfer roller accommodation part 43 and extends in a front-lower direction. The sheet conveyance guide 44 is integrally provided with a plurality of (four) fitting protrusions 50.

Figure 4A:
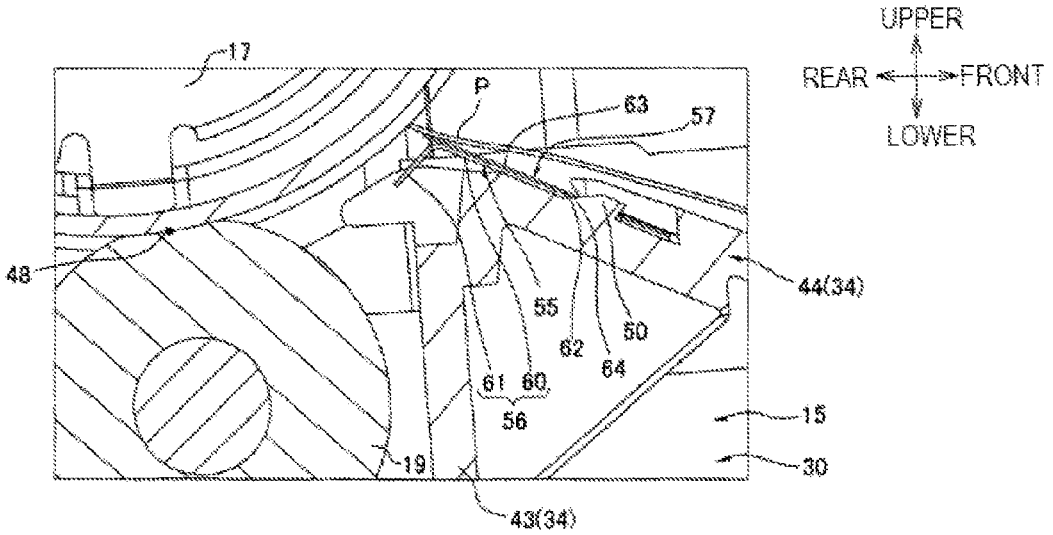
FIG. 4A shows a state where a leading end of the sheet contacts a photosensitive drum.

As shown in FIGS. 2 and 4, the fitting protrusions 50 are arranged at an interval in the left-right direction, are integrally formed with the sheet conveyance guide 44 and protrude forwards from a front-upper surface of a substantially central portion of the sheet conveyance guide 44 in the front-rear direction. The fitting protrusions 50 are formed so that they can engage with a two-layered film 55 (which will be described later) on the upper surface of the sheet conveyance guide 44.

As shown in FIG. 4, the sheet conveyance guide 44 is provided with the two-layered film 55 that is an example of the guide member.

The two-layered film 55 has a bent film 56 that is an example of the second guide member and a straight film 57 that is an example of the first guide member.

The bent film 56 is made of a flexible resin film and is long in the left-right direction. The bent film 56 has a sheet guide auxiliary part 60 that is an example of the first part and a sheet rear end supporting part 61 that is an example of the second part.

The sheet guide auxiliary part 60 is arranged to cover an upper surface of a rear side part of the sheet conveyance guide 44 and to extend in a rear-upper direction towards the photosensitive drum 17. The sheet guide auxiliary part 60 is formed with a plurality of (four) first fitting holes 62.

The first fitting holes 62 are arranged at an interval in the left-right direction so that they overlap with the fitting protrusions 50 when projected in the upper-lower direction. The first fitting holes 62 are through-holes having a substantially rectangular shape when seen in the plan view.

The sheet rear end supporting part 61 is formed to extend in a rear-lower direction towards the transfer roller 19 continuously from a rear end portion of the sheet guide auxiliary part 60. That is, the sheet rear end supporting part 61 is formed to bend towards the nip portion 48 side continuously from a rear end portion of the sheet guide auxiliary part 60. A rear end portion of the sheet rear end supporting part 61 faces the nip portion 48 with an interval in the front-rear direction.

The straight film 57 is made of a flexible resin film thinner than the bent film 56, is long in the left-right direction and contacts an upper surface of the sheet guide auxiliary part 60. A rear end portion of the straight film 57 is formed so as to extend more in the rear-upper direction towards the photosensitive drum 17 than the rear end portion of the sheet guide auxiliary part 60. Further, the rear end portion of the straight film 57 is arranged at the front of the rear end portion of the sheet rear end supporting part 61. Also, the straight film 57 is formed with a plurality of (four) second fitting holes 64.

The second fitting holes 64 are arranged at an interval in the left-right direction so that they overlap with the fitting protrusions 50 when projected in the upper-lower direction. The second fitting holes 62 are through-holes having a substantially rectangular shape when seen in the plan view.

In the meantime, an upper surface of the straight film 57 is defined as a sheet guide surface 63 (which is an example of the guide surface). Accordingly, a surface of the straight film 57, which is opposite to the sheet guide surface 63, contacts the sheet guide auxiliary part 60 of the bent film 56.

The bent film 56 and the straight film 57 are overlapped and the fitting protrusions 50 are fitted in the corresponding fitting holes (the first fitting holes 62 and the second fitting holes 64), so that the two-layered film 55 is fixed to the sheet conveyance guide 44.

As shown in FIGS. 2 and 3, the developing cartridge supporting part 42 is arranged at the front of the sheet conveyance guide 44. The developing cartridge supporting part 42 has a substantially flat plate shape in which a rear end portion thereof is positioned with an interval at the front-upper side of the sheet conveyance guide 44 and a front end portion thereof is connected to a lower end portion of the front-side wall 32. The developing cartridge supporting part 42 is formed with a process-side registration roller accommodation part 47.

The process-side registration roller accommodation part 47 has a substantially U-shaped side section that protrudes upwards so as to follow a circumferential surface of the process-side registration roller 21 at a substantially central portion of the developing cartridge supporting part 42 in the front-rear direction.

As shown in FIG. 3, the drum frame 30 is formed so that an opening area among both the sidewalls 31, a front end portion of the sheet conveyance guide 44 of the lower-side wall 34 and a rear end portion of the developing cartridge supporting part 42 of the lower-side wall 34 is defined as the sheet feeding opening 67 through which the sheet P is fed to the nip portion 48. Also, an opening area among both the sidewalls 31, a rear end portion of the transfer roller accommodation part 43 of the lower-side wall 34 and a front-lower end portion of the drum cleaning roller holding part 40 of the upper-side wall 33 is defined as the sheet discharge opening 68 through which the sheet P is discharged from the nip portion 48.

As described above, the drum cartridge 15 has the photosensitive drum 17, the scorotron-type charger 18, the drum cleaning roller 38, the transfer roller 19 and the process-side registration roller 21.

Both left and right end portions of the drum shaft 46 are rotatably inserted into the drum shaft insertion holes 35 of both the sidewalls 31 from inner sides in the left-right direction, so that the photosensitive drum 17 is rotatably (in a clockwise direction, when seen from the left side) provided to the drum cartridge 15 (refer to FIG. 2).

The scorotron-type charger 18 is fittingly supported to the charger supporting part 41 of the upper-side wall 33 and is arranged to face the photosensitive drum 17 with an interval above the photosensitive drum 17.

The drum cleaning roller 38 extends in the left-right direction, is rotatably supported to the drum cleaning roller holding part 40 of the upper-side wall 33 and contacts the rear-upper side of the photosensitive drum 17 with a front-lower part thereof being exposed.

The transfer roller 19 extends in the left-right direction, is rotatably (in a counterclockwise direction, when seen from the left side) supported in the transfer roller accommodation part 43 and contacts the lower side of the photosensitive drum 17 with an upper part thereof being exposed.

The process-side registration roller 21 extends in the left-right direction and is rotatably supported in the process-side registration roller accommodation part 47 of the lower-side wall 34.

Meanwhile, in the drum cartridge 15, a developing cartridge mounting part 45 for mounting the developing cartridge 16 is defined by both the sidewalls 31, the developing cartridge supporting part 42, the sheet conveyance guide 44, the front-side wall 32 and the photosensitive drum 17.

The developing cartridge 16 is detachably mounted to the developing cartridge mounting part 45 (refer to FIG. 1).

3. Sheet Conveyance

As described above, the sheet P is fed one by one from the sheet feeding tray 6 to the process cartridge 13 of the image forming unit 4 at predetermined timing.

Figure 4B:
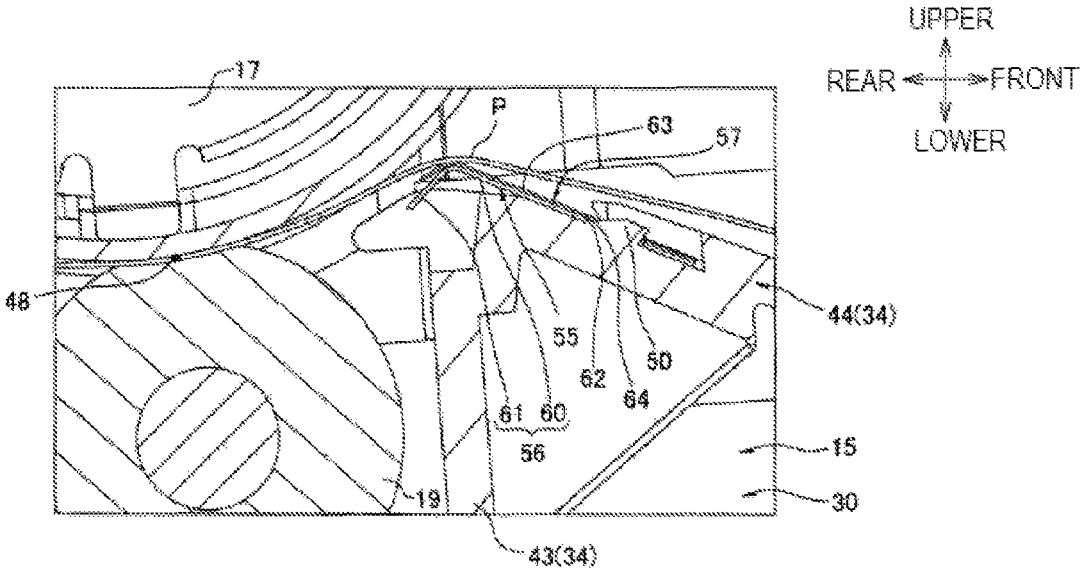
FIG. 4B shows a state where the sheet is being conveyed and FIG. 4C shows a state where a rear end of the sheet is spaced from a sheet guide surface and contacts a sheet rear end supporting part.

Thereby, the sheet P is guided so that the leading end thereof passes through the sheet feeding opening 67 from the front side towards the rear side, as shown in FIG. 3, and contacts the photosensitive drum 17 along the sheet guide surface 63 of the straight film 57 of the two-layered film 55, as shown in FIG. 4B.

As shown in FIG. 4B, the sheet P contacting the photosensitive drum 17 is guided towards the nip portion 48 as the photosensitive drum 17 is rotated (in the clockwise direction, when seen from the left side). Then, the toner image is transferred at the nip portion 48, so that the sheet P is formed with an image. At this time, since the sheet P is tensioned towards the nip portion 48 by the rotations of the photosensitive drum 17 and the transfer roller 19, the sheet P is conveyed while the rear end portion of the straight film 57 is bent downwards.

After that, as shown in FIG. 3, the sheet P passes through the sheet discharge opening 68 towards the further rear side and is conveyed towards between the heating roller 25 and the pressing roller 26 (refer to FIG. 1).

Figure 4C:
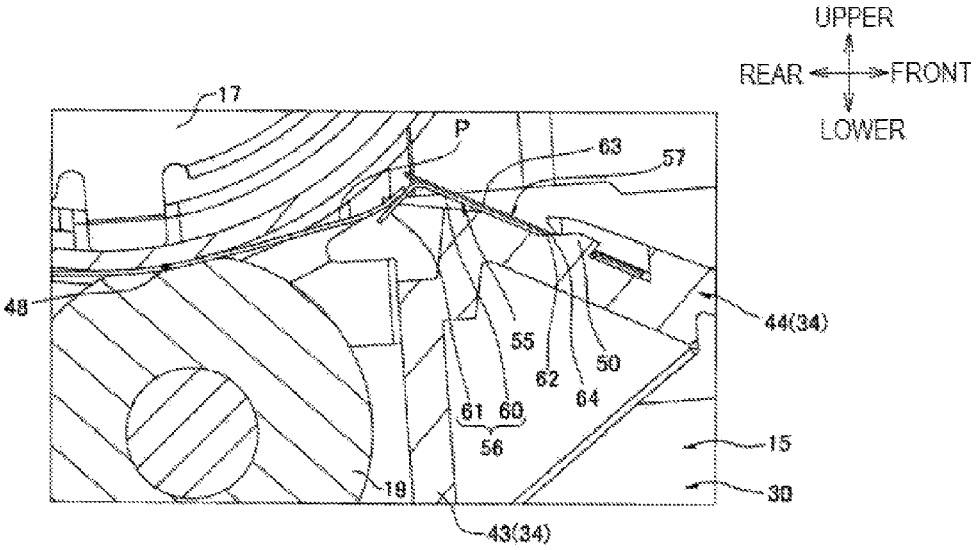

In the meantime, as shown in FIG. 4C, while the sheet P is conveyed rearwards, the rear end of the sheet P is spaced from the sheet guide surface 63, contacts the sheet rear end supporting part 61 and is guided to the nip portion 48 along the sheet rear end supporting part 61.

4. Operational Effects (1) According to the above drum cartridge 15, as shown in FIG. 4, the straight film 57 guides the sheet P towards the photosensitive drum 17 by the sheet guide surface 63 while contacting the sheet guide auxiliary part 60 of the bent film 56, and the sheet P is conveyed towards the nip portion 48 after the leading end thereof abuts on the photosensitive drum 17. The rear end of the sheet P conveyed as described above is spaced from the sheet guide surface 63, contacts the sheet rear end supporting part 61 of the bent film 56 bent towards the nip portion 48 side and is conveyed to the vicinity of the nip portion 48.

Therefore, it is possible to guide the sheet P towards the photosensitive drum 17 and to guide the same to just in front of the nip portion 48 by the sheet rear end supporting part 61 of the bent film 56. Also, it is possible to suppress a continuous part of the sheet guide auxiliary part 60 and the sheet rear end supporting part 61 of the bent film 56 from rubbing against the sheet P by the straight film 57 extending towards the photosensitive drum 17.

As a result, it is possible to reliably guide the sheet P towards the nip portion 48 and to secure the abrasion resistance against rubbing with the sheet P.

(2) Also, according to the above drum cartridge 15, as shown in FIG. 4, the rear end portion (the downstream end in the guide direction) of the sheet rear end supporting part 61 of the bent film 56 is arranged at the rear side (the downstream side in the guide direction) of the rear end portion (the downstream end in the guide direction) of the straight film 57.

Therefore, when the sheet P is conveyed towards the nip portion 48 and is spaced from the straight film 57, it is possible to prevent the rear end of the sheet P from swiftly falling down by the contact with the sheet rear end supporting part 61.

As a result, it is possible to guide the sheet P towards the photosensitive drum 17 and to guide the same to just in front of the nip portion 48 by the sheet rear end supporting part 61 of the bent film 56.

(3) Also, according to the above drum cartridge 15, as shown in FIG. 4, since the two-layered film 55 includes the straight film 57 and the bent film 56, it is possible to make one of the films thinner.

For example, when the sheet P is guided only by the straight film 57, it is necessary to provide the straight film 57 with enough strength to support the sheet P.

In this case, a corner of a rear end edge (a downstream end in the guide direction) of the straight film 57 may abut on the sheet P, so that a noise is generated.

However, the straight film 57 is made to be thinner than the bent film 56, so that the straight film 57 has the higher flexibility than the bent film 56.

Thereby, by the straight film 57 being bent more, it is possible to suppress the abutting of the sheet P and the corner of the rear end edge of the straight film 57 and to thus suppress the noise from being generated due to the abutting of the sheet P and the corner of the straight film 57.

(4) Also, according to the above drum cartridge 15, as shown in FIG. 4, it is possible to fix the straight film 57 and the bent film 56 by the fitting protrusions 50 protruding from the sheet conveyance guide 44 of the drum frame 30.

Therefore, it is possible to position the straight film 57 and the bent film 56 with respect to the frame in high precision by a simple and easy configuration of engaging the fitting protrusions 50 to the straight film 57 and the bent film 56.

5. Second Illustrative Embodiment

A second illustrative embodiment of the drum cartridge is described with reference to FIG. 5. Meanwhile, in the second illustrative embodiment, the same members as those of the first illustrative embodiment are denoted with the same reference numerals and the descriptions thereof are omitted.

In the first illustrative embodiment, the bent film 56 and the straight film 57 are overlapped and the fitting protrusions 50 are fitted to the fitting holes (the first fitting holes 62 and the second fitting holes 64), so that the two-layered film 55 is fixed to the sheet conveyance guide 44 (refer to FIG. 4).

Compared to this, in the second illustrative embodiment of the invention, the fitting holes (the first fitting holes 62 and the second fitting holes 64) and the corresponding fitting protrusions 50 are not formed, and the bent film 56 and the straight film 57 are adhered (pasted) by an adhesive and the like to thus configure the two-layered film 55. The two-layered film 55 and the upper surface of the sheet conveyance guide 44 are adhered (pasted) by an adhesive and the like.

Figure 5:
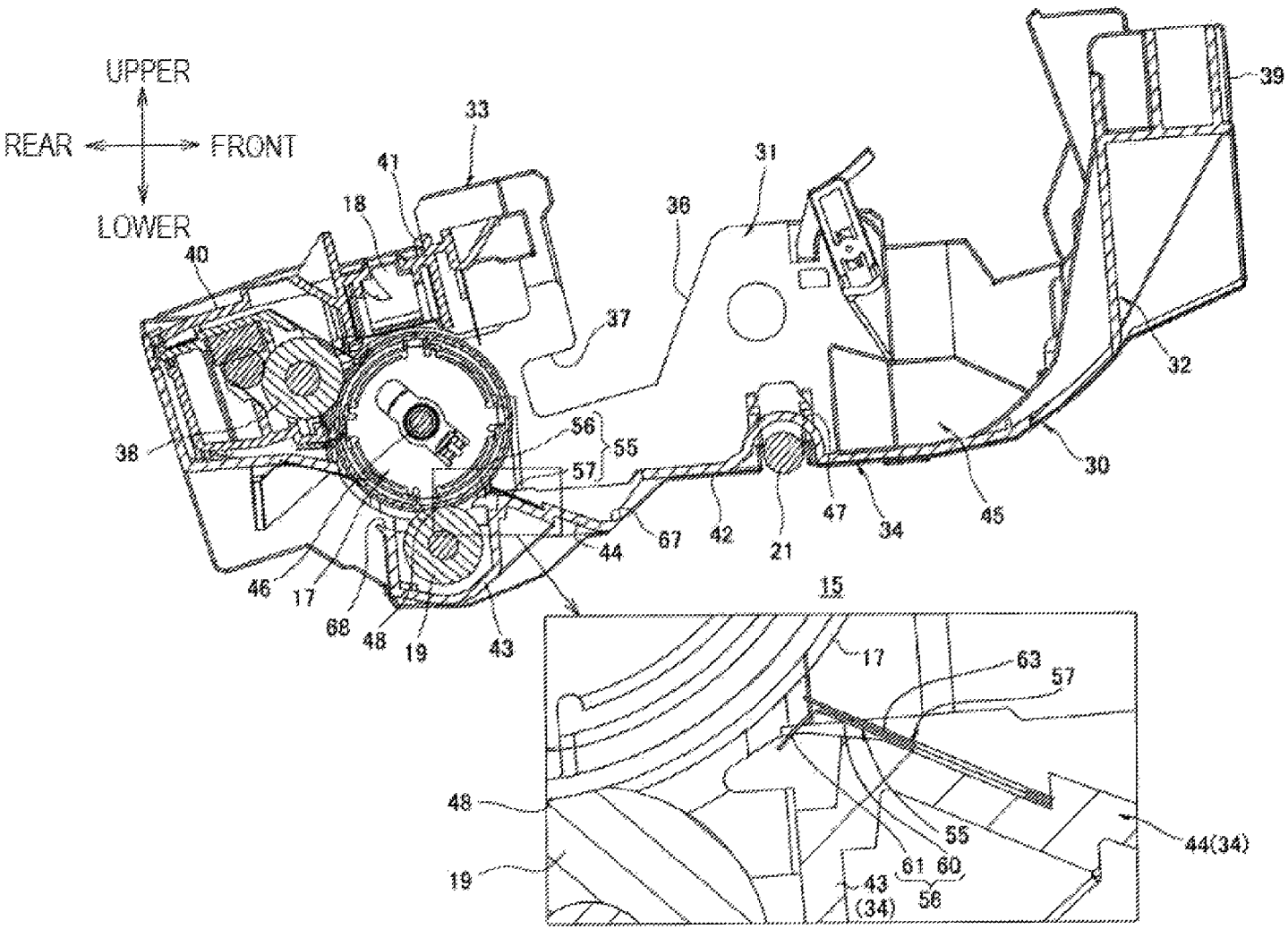
FIG. 5 is a sectional view of a drum cartridge of a second illustrative embodiment, which is seen from a left side.

According to the second illustrative embodiment, as shown in FIG. 5, it is possible to fix the straight film 57 to the sheet guide auxiliary part 60 of the bent film 56 by a simple and easy configuration of adhering (pasting) the straight film 57 to the sheet guide auxiliary part 60 of the bent film 56 by the adhesive and the like.

Also in the second illustrative embodiment, it is possible to obtain the same operational effects as those of the first illustrative embodiment.

What is claimed is:

1. A drum cartridge comprising:

a photosensitive drum;

a straight film configured to guide a recording medium towards the photosensitive drum; and a bent film arranged at a lower side of the straight film and configured to support the straight film, wherein the bent film includes, a sheet guide auxiliary part contacting the straight film and including a first end portion closest to the photosensitive drum and a second end portion farthest away from the photosensitive drum, and a sheet rear end supporting part connected to the first end portion of the sheet guide auxiliary part and extending downwards from the first end portion of the sheet guide auxiliary part.

2. The drum cartridge according to claim 1, wherein a thickness of the straight film is smaller than a thickness of the bent film.

3. The drum cartridge according to claim 1, further comprising a frame including a protrusion, wherein the sheet guide auxiliary part of the bent film has a first hole that receives the protrusion of the frame.

4. The drum cartridge according to claim 3, wherein the straight film has a second hole that receives the protrusion of the frame.

5. The drum cartridge according to claim 1, wherein a length of the bent film in a conveyance direction of the recording medium is longer than a length of the straight film in the conveyance direction of the recording medium.

6. The drum cartridge according to claim 1, wherein a length of the sheet guide auxiliary part of the bent film in a conveyance direction of the recording medium is shorter than a length of the straight film in the conveyance direction of the recording medium.

* * * * *